US008225538B2

(12) United States Patent
Warren et al.

(10) Patent No.: US 8,225,538 B2
(45) Date of Patent: Jul. 24, 2012

(54) GARMENT HANGER AND INDICIA TAG

(75) Inventors: Michael Warren, London (GB); Andrew Niccol, Auckland (NZ)

(73) Assignee: Braitrim (UK) Ltd, Greater London (GB)

( * ) Notice: Subject to any disclaimer, the term of this patent is extended or adjusted under 35 U.S.C. 154(b) by 0 days.

(21) Appl. No.: 13/056,095

(22) PCT Filed: Oct. 2, 2009

(86) PCT No.: PCT/GB2009/051302

§ 371 (c)(1),
(2), (4) Date: Jan. 26, 2011

(87) PCT Pub. No.: WO2010/038084

PCT Pub. Date: Apr. 8, 2010

(65) Prior Publication Data

US 2011/0126438 A1 Jun. 2, 2011

(30) Foreign Application Priority Data

Oct. 3, 2008 (GB) ..... 0818106.7

(51) Int. Cl.
*A47G 25/14* (2006.01)

(52) U.S. Cl. ..... 40/322; 223/85

(58) Field of Classification Search ..... 40/322; 223/85

See application file for complete search history.

(56) References Cited

U.S. PATENT DOCUMENTS 3,588,965 A * 6/1971 Terkel et al. ..... 24/23 W
5,611,469 A 3/1997 Eiley
5,950,883 A 9/1999 Bond
6,019,260 A 1/2000 Gouldson

FOREIGN PATENT DOCUMENTS

CA 2115188 10/1994
JP 06066425 9/1994

* cited by examiner

*Primary Examiner* — Casandra Davis
(74) *Attorney, Agent, or Firm* — Neifeld IP Law, PC

(57) ABSTRACT

A garment hanger (10) and a resilient indicia tag (30) wherein the garment hanger comprises a web (40) arranged to latch the indicia tag thereto. The web defines an aperture (45) therethrough. The indicia tag (30) is substantially U-shaped in cross-section having a first leg (31) and a second leg (32) opposed to the first leg arranged such that the web (40) is receivable between the first leg and the second leg. A cooperating latch (451, 33) is provided on the web and on an inner face of the first leg for latching the indicia tag to the web. With the indicia tag (30) latched to the web (40) an inner face of the first leg (31) is accessible through the aperture (45) to a tool resiliently to flex at least a portion of the first leg away from the web such that the latching means mutually disengage.

16 Claims, 11 Drawing Sheets

SECTION C-C

GARMENT HANGER AND INDICIA TAG

This invention relates to a garment hanger indicia tag and a garment hanger for receiving the indicia tag.

Indicia tag for garment hangers are known, especially in retail establishments, usually for indicating some attribute, such as size or designer, of a garment suspended from the garment hanger. Alternatively, such indicia tag may be used for indicating that a garment suspended from the garment hanger is, for example, a sale item.

Irremovable Tags

U.S. Pat. No. 5,135,141 and U.S. Pat. No. 5,785,216 disclose garment hangers with indicia tags formed of insets of a different material from the garment hanger and in which the insert and garment hanger are bonded together.

U.S. Pat. No. 5,469,995 discloses a hanger with a tab holding section which accommodates a single-use, size-indicating resilient tab such that the tab is substantially irremovable without damaging the tab to make the tab unusable to avoid a tab being removed and lodged in a child's throat but which can be assembled onto the hanger without assemblers developing carpal tunnel syndrome. The U-shaped tab with inward projecting portions at free ends of the legs engages a bullet shaped protrusion on the hanger by snapping around an inward end of the projection.

U.S. Pat. No. 5,096,101 discloses a moulded thermoplastic hanger with a tab holder for receiving a pincer-type locking information tab of resilient thermoplastic having projections which are captured by an enlarged region of the tab holder for substantially preventing removal of the tab. Inward ends of tab, the tab being substantially U-shaped in cross-section, are curved inwardly to prevent grasping thereof.

U.S. Pat. No. 5,683,018 discloses a resilient, locking, PVC or nylon information clip for a hanger for engaging a ledge of a clip holder such that removal of the clip is prevented or seriously inhibited, for example by inhibiting lifting one or both sides by use of fingers or fingernails, making the clip child proof and preventing manual removal by others in which inner and outer locking hooks on the U-shaped cross-section clip engage with engagement tabs on the hanger.

However, in many applications it is desirable that the indicia tag be detachably fixable to the garment hanger for re-use of the garment hanger or indicia tag or both the garment hanger and the indicia tag. Moreover, it may be desirable to be able to use a same garment hanger alternatively without an indicia tag without the tab holding means being practically or aesthetically obstructive.

Tags Removable by Hand

Indicia tags or tabs are known which are readily removable by hand. Thus U.S. Pat. No. 3,949,914 discloses a size marker device with resilient clasps for detachable connection to a flange of a hanger hook by snapping thereto. The marker can subsequently be pulled from the hanger.

U.S. Pat. No. 4,017,990 discloses a cylindrical, open-topped tally, which is additionally provided with a flat resilient sheet have a portion of the sheet dimensioned for insertion into the open top of the tally. The portion for insertion is wider than an inside diameter of the tally and the portion to be inserted is resiliently distorted for insertion so that by means of the resilience of the inserted portion a tight wedging engagement is formed.

U.S. Pat. No. 4,115,940 discloses a tab-holding web integrally formed between an angled shank of a hook of a garment hanger and an arm of the garment hanger for receiving convergent legs of a removable, resilient tab, generally U-shaped in cross-section, one leg each side of the tab-holding web. Internal projections on the respective inside faces of the legs engage a ledge on the outer edge of the web. The U-shaped tab is provided with terminal outwardly extending ribs to provide sufficient purchase for fingers in order easily to remove the tab so that the tab is removable and changeable, but sufficiently firmly attached to reduce accidental disengagement.

U.S. Pat. No. 4,198,773 discloses a cylindrical tally for fitting around a shank of a wire hook of a garment hanger. An upper surface of a median portion of the garment hanger may be provided with a boss or other projections, around a point of entry of the shank into the median portion, on which the cylindrical tally may be seated.

U.S. Pat. No. 4,450,639 discloses a garment hanger of, for example, polyethylene, polystyrene or polycarbonate, having a panel, vertical in use and angled to a major plane of the garment hanger, on a vertical, in use, portion of a hook of the garment hanger. A rectangular printed sheet with a self-adhesive back face may be adhered to the angled panel so that the printed sheet is visible from both the front and one end of the garment hanger. If the garment hanger is to be used for a different garment, the self-adhesive sheet has to be stripped off and replaced with a new sheet having different indicia tag. Alternatively, a moulded or formed sheet of plastic, metal or resin-impregnated paper can be detachably snapped onto the panel.

U.S. Pat. No. 4,997,114 discloses a resilient, preferably plastic, planar, U-shaped indicia tag having engagement means on inside walls of legs of the U-shaped indicia tag for fitting to I-section garment hangers. The indicia tag is removable and interchangeable as desired while preventing accidental detachment. In a first embodiment a recess is provided with cooperating engagement means for suspending the indicia tag from an inclined shank of a suspension hook of a garment hanger. In a second embodiment a recess with cooperating engagement means is provided in an inclined portion of a hook above a shank thereof such that in use the indicia tag is upstanding from the inclined portion of the hook. In a third embodiment two upright sets of support ribs are provided on opposed sides of a web of a linear I-section arm of a garment hanger and instead of engagement means the inner faces of the legs of the U-shaped indicia tag are provided with inward-facing projections to act as stop means. To locate the indicia tag on the arm of the garment hanger, the inward facing projections are passed resiliently over a raised border of the I-section arm and each of the legs passed between a pair of the support ribs. The inward facing projections prevent the indicia tag falling from the garment hanger when the garment hanger is turned upside down, by abutting against an inner face of the raised border. The indicia tag carrying tab is easily removed by pulling the tab. There is no disclosure of use of such a tag with other than an I-section garment hanger.

U.S. Pat. No. 6,209,241 discloses an index coded cap, having a generally U-shaped cross-section, for fitting over a web or projection on an uppermost portion of a hook of a garment hanger. The web or projection is somewhat obtrusive when the index coded caps are not used with the garment hangers. The cap is arranged for releasable connection to a top of a suspension hook of a garment hanger. Opposed tabs rising from an upper face of the hanger hook include notches for engaging protrusions on the substantial planar indicator to form a snap fit. The size cap may be easily released by applying opposed outward forces to the opposed tabs while preventing inadvertent separation of the size cap which could result in loss of the size cap and a safety hazard to children.

Tags Irremovable or Removable by a Hand Tool

To make garment hanger tabs which are more childproof than those readily removed by hand, indicia tags are known which may be removed from a garment hanger only with the use of a tool, in particular a hand tool.

Thus U.S. Pat. Nos. 5,199,608; 5,238,159; 5,305,933; 5,383,583; 5,613,629; 5,819,995 and 6,145,713 disclose resilient indicia tag-bearing tabs easily mounted by sales staff or garment manufacturers on an edge of a tab holder of a hanger in which a ridge or rib prevents a consumer obtaining a finger purchase on the tab. The tabs are generally U-shaped or V-shaped in cross-section with convergent or parallel legs. End members may prevent a customer obtaining a finger or fingernail purchase on edge surfaces of the tab so that the tab cannot be removed without a tool, to prevent removal and ingesting by a child or accidentally dislodgement by a customer. The tab and garment hanger are of a material such as polystyrene, polypropylene, ABS or nylon. However, dimensions and locations of the ridge and end members may be selected such that removal may be prevented by hand or by use of a tool, without breaking the tab. There is no disclosure how the tab might be removed with a tool nor the nature of a tool required.

EP 0512225; U.S. Pat. No. 5,603,437 disclose index coded caps, having a generally U-shaped cross-section, for fitting over webs or projections on an uppermost portion of a hook of a garment hanger. EP 0512225 discloses an automated system for sizing hangers with indicating means at a time a garment is suspended from the hanger by forming a snap fit between the indicating means and a flange on the hanger in which the snap fit engagement is relatively permanent, stiffness of the cap determining a degree of difficulty in removing the cap, the fit and cooperation of a flat edge of the cap and a horizontal flange making it difficult to insert a screwdriver or other means for prying sidewalls of the cap apart to remove the cap. There is no disclosure how the caps may readily be removed from the hanger. U.S. Pat. No. 5,603,437 discloses a solid moulded plastic indicator with opposed projections arranged to be received in apertures in upwardly projecting webs located on a top of a hook of the hanger to provide a reasonably secure attachment of the indicator to the garment hanger by an interference fit. An interaction of the indicator projection and the hanger web aperture serves to lock the indicator to the hanger against accidental misplacement.

U.S. Pat. Nos. 6,264,075 and 6,422,437 disclose a garment hanger with a releasable size indicator with a U-shaped cross-section having first and second legs, the first leg engaging a fixed latch on a web and the second leg engaging an oppositely deposed pivoting latch attached by a living hinge to the web. The latched tab is considered childproof because a force of 25-30 pounds is required to pull the size indicator from the latches. For re-use of the hanger, the tab may be released by a tool which passes between the tab and the garment hanger to engage the pivoting latch to move the pivoting latch out of engagement with the second leg and the first leg out of engagement with the fixed latch. According to the disclosure if the size indicator is made from a resilient material the size indicator then pops off the web without further manual intervention although in practice it is found that the released tab may need to be grasped to remove the tab from the garment hanger. Release and removal of the tab requires sufficient dexterity to make removal of the size indicator substantially childproof. Clearly the garment hanger has to be of a material suitable for the inclusion of a living hinge for the pivoting latch.

U.S. Pat. No. 5,485,943 discloses an information tab of V-shaped cross-section which is easily mounted on a tab holder comprising a ridge and end members preventing a consumer from obtaining a sufficient finger purchase on the tab so that the tab cannot be removed without use of a tool, to prevent the tab being removed by a consumer and swallowed by a child or being inadvertently dislodged in a retail establishment. The hanger and information tab are formed of material such as polystyrene, polypropylene, ABS or nylon. In an embodiment, the information tab cannot be removed even with a tool, without breaking the information tab. There is no disclosure how the tab may be removed with a tool.

U.S. Pat. No. 5,778,575 discloses a garment hanger with a tab-receiving web to receive a folding size tab. The size tab may have opposed latches which engage through an opening in the hanger to lock the tab on the hanger to prevent inadvertent dislodgement. The hanger is preferably moulded thermoplastic such as polypropylene or polystyrene. The garment hanger has a generally triangular, tab-receiving web extension to an upper portion of a hook of the garment hanger opposed to a free end of the hook, having linear horizontal and linear vertical outer edges and an arcuate inner edge following an inner curve of the hook. There is also disclosed a foldable tab, which is moulded flat but foldable along living hinges into a U-shape cross-section for fitting over the tab-receiving web. The foldable tab is provided with projections for engaging an aperture in the tab-receiving web for locking the tab on the tab-receiving web. The tab-receiving web is very aesthetically obtrusive.

U.S. Pat. Nos. 5,950,883 and 5,687,887 disclose a self-locking resilient plastic marker or sizer for a plastic moulded hanger for attachment to the hanger before shipment of the hanger and garment but which is removable by use of a hand tool for reuse of the hanger but is not removable by hand and is therefore child-resistant. The plastic marker has a U-shaped cross-section with flanges on the legs for snapping over a rib on the hanger. Alternatively the legs may snap outwardly for projections thereon to engage opposed recesses in the hanger. Parallel walls on the hanger form beads to preclude removal of the marker without a tool. The marker is provided with at least one recess at respective free ends of the legs to permit engagement of the tool which has jaws which pass through recesses in the flange oppositely disposed to the recesses in the marker to engage the recesses in the marker and splay apart the legs, or in the alternative embodiment, to squeeze together the legs, to allow the marker to be lifted off the hanger. In a further embodiment the marker cannot be removed from the hanger, even with use of a tool.

U.S. Pat. No. 5,642,840 discloses a resilient thermoplastic locking tab with a C-shaped cross-section which is easily mounted by sales staff or garment manufacturers, the tab having resilient fingers to snap into a slot in a tab holder on a thermoplastic hanger e.g. of polystyrene, polypropylene, ABS or nylon, substantially to inhibit removal of the tab without use of a tool. There is no disclosure how, or with what type of tool, the tab is removed.

U.S. Pat. No. 5,611,469 discloses a resilient moulded plastic or metal identification clip with a U-shaped cross-section for a moulded plastic garment hanger to engage a retaining pin and flange of a clip holder of the hanger to prevent easy manual removal of the clip from the hanger to be childproof but which can be repeatedly removed with a tool without weakening the tab. There is no disclosure how, or with what type of tool, the tab is removed.

U.S. Pat. No. 5,407,109 discloses a resilient, locking, childproof, thermoplastic, asymmetrical tab with a U-shaped cross-section arranged so that the tab can be inserted only in a preferred orientation, for example without inverting information carried thereon, on a tab holder on a thermoplastic hanger. It is indicated that different embodiments may be more or less susceptible to accidental or intentional removal of the tab from the tab holder, without disclosing any means by which the tab is to be removed.

U.S. Pat. No. 5,449,099 discloses a childproof size-indicating U-shaped cross-section tab and a hand tool for removing the tab from a garment hanger and discarding the tab when installed by mistake in an assembly line. Legs of the U-shaped tab terminate in inwardly curved portions. A base portion of a tab-holding portion of the hanger prevents the tab from being pulled frontward and off the hanger and protective ribs prevent small fingers from obtaining a purchase on the inwardly curved ends of the tab. To remove the tab, fingers of a tool extend through channels in the tab holder to pry the ends of the tab away from a receiving section of the tab holder to pull the tab from the tab holder. The tool comprises two arms hinged together and terminating in their free ends in fingers for engaging the ends of the tab.

U.S. Pat. No. 5,641,100 discloses a garment hanger having a substantially triangular recess in an upper portion of a hook for receiving a resilient, substantially triangular, planar, releasable indicia tag plate of, for example, high impact polystyrene, secured by at least one projection at a periphery of the recess. The recess is aesthetically obtrusive when not used to house an indicia tag plate. The indicia tag plate is removed by pushing an implement through an opening in a base of the recess so that the indicia tag plate flexes past the at least one projection.

GB 2310596 discloses an indicia tag holder comprising a generally elliptical releasable plate. The plate is provided on a rear major surface with projections for passing through elongate slots in an elliptical receiving portion of a garment hanger. The elliptical receiving portion is provided with flanges and ramps for affixing the indicia tag holder thereto. The elliptical receiving portion is obtrusive when the garment hanger is used without the elliptical indicia tag holder. To remove the indicia tag element a tool such as a pencil is inserted through a notch in a peripheral wall of the elliptical receiving portion so as to lift and deform the plate to dislodge the plate from the flanges.

Tags Removable by an Automatic Tool

As well as the requirement for childproof indicia tags, there is an increasing requirement for re-use or recycling of garment hangers and indicia tags. Preferably an automated system is required for removing childproof indicia tags from garment hangers before re-use or recycling of either the garment hanger, or indicia tag or both the garment hanger and the indicia tag.

U.S. Pat. No. 5,558,280 and U.S. Pat. No. 5,785,260 disclose a system for re-using and recycling garment hangers but there is only a passing mention of removal of size indicating parts during renovation of garment hangers before re-use without any indication of a suitable size marker or a method of removal.

GB 2 314 073 and U.S. Pat. No. 5,944,237 disclose a method of re-using garment hangers with size indicia tags including automated removal of the size indicia tags for reuse of both the garment hangers and the colour coded indicia tags. The size indicia tag is a cap which is received on an upstanding web on a top of a suspension hook of the hanger. An aperture is provided in a wall of the cap to receive a resilient detent leg extending from the web to retain the cap on the web in normal use. There is no suggestion that the removal of the cap is childproof. For automated removal of the cap a probe or pin engages the detent leg to displace the leg from the aperture back into the plane of the web and to clear the aperture. The cap has then to be removed by a back plate having a recess to receive the cap and the cap is removed from the recess by, for example, an air blast.

U.S. Pat. No. 5,794,363 also discloses a hanger hook, for example of styrene, K resin, high impact styrene or polypropylene, with a top cap sizer with an upstanding web comprising at least one resilient detent engagement means for securing the top sizer by each passing into an aperture in a wall of the cap, to prevent inadvertent release of the cap but which enables the top sizer to be intentionally removed in a simple operation for re-use of the hanger by insertion of a probe into the aperture to displace the detent engagement means from the aperture. Difficulty in removing the cap can be increased by providing a relatively resilient garment hanger and a relatively stiff cap so that it is difficult to remove the cap by inserting a screwdriver to pry the sides of the cap apart. There is no disclosure that the garment hanger and tab are suitable for automated removal of the tab, although the tab appears to be very similar to that disclosed in GB 2 314 073.

It is an object of the present invention at least to ameliorate the shortcomings in the prior art.

According to a first aspect of the present invention there is provided a combination of a garment hanger and a resilient indicia tag wherein the garment hanger comprises a web arranged to latch the indicia tag thereto, the web defining an aperture therethrough, wherein the indicia tag is substantially U-shaped in cross-section having a first leg and a second leg opposed to the first leg arranged such that the web is receivable between the first leg and the second leg and cooperating latching means on the web and an inner face of the first leg for latching the indicia tag to the web such that with the indicia tag latched to the web an inner face of the first leg is accessible through the aperture to a tool resiliently to flex at least a portion of the first leg away from the web such that the latching means mutually disengage.

Advantageously, the web comprises a peripheral step between the web and an adjacent outer face of the garment hanger, the step being of a height at least substantially equal to a thickness of the legs of the indicia tag so that, with the indicia tag mounted on the web, an edge of the indicia tag abuts the step with substantially no fingernail purchase therebetween and major outer faces of the indicia tag are substantially coplanar with adjacent outer faces of the garment hanger.

Conveniently, the second leg is shorter than the first leg to provide access to the aperture when the indicia tag is mounted on the web.

Alternatively, the second leg comprises a cutaway to provide access to the aperture when the indicia tag is mounted on the web.

Advantageously, a first portion of the cooperating latching means is fixed relative to the first leg and a second portion of the cooperating latching means for cooperating with the first portion is fixed relative to the web.

Conveniently, the first portion of the cooperating latching means comprises a projection on an inner face of the first leg and the second portion of the cooperating latching means comprises an edge of the aperture.

Advantageously, the projection is a T-shaped projection having a stem portion in a direction of mounting the indicia tag on the web and a cross-bar portion substantially perpendicular thereto and distal from a free end of the legs thereof.

Advantageously, the stem portion comprises a ramp having a cam face rising from an inner face of the first leg to the outer face of the cross-bar portion.

Alternatively, the first portion of the cooperating latching means comprises a first projection on an inner face of the first leg and the second portion of the cooperating latching means comprises a cooperating second projection on the web.

Advantageously, the first projection comprises first ramp means have a first cam surface and the second projection comprises second ramp means having a second cam surface for cooperating with the first cam surface.

Conveniently, the web is located at a junction of suspension hook means of the garment hanger and a median portion of the garment hanger.

Conveniently, the suspension hook means and median portion are moulded in one piece Alternatively, the suspension hook is moulded separately from remaining portions of the garment hanger and the web is located on the suspension hook means.

Conveniently, a major face of the first leg is substantially quadrant shaped.

Conveniently, a major face of the second leg is substantially quadrant shaped.

Alternatively, a major face of the second leg is substantially rectangular.

Advantageously, the indicia tag comprises on an inner face thereof a seat for receiving an outer edge of the web.

Conveniently, the tool is a probe.

Conveniently, the aperture is provided with an outermost ramped edge for guiding the tool.

Conveniently, information is printed or affixed to at least one outer face of the indicia tag.

According to a second aspect of the invention, there is provided a resilient indicia tag for latching to a web of a garment hanger, the web defining an aperture therethrough, wherein the indicia tag is substantially U-shaped in cross-section having a first leg and a second leg opposed to the first leg arranged such that the web is receivable between the first leg and the second leg and cooperating latching means on an inner face of the first leg for latching the indicia tag to the web, wherein the second leg is arranged so that with the indicia tag latched to the web an inner face of the first leg is accessible through the aperture by a tool resiliently to flex at least a portion of the first leg away from the web to disengage the latching means.

Conveniently, the indicia tag is arranged such that an edge of the indicia tag abuts a peripheral step between the web and an adjacent outer face of the garment hanger with substantially no fingernail purchase therebetween, the step being of a height at least substantially equal to a thickness of the legs of the indicia tag, so that, with the indicia tag mounted on the web, major outer faces of the indicia tag are substantially coplanar with adjacent outer faces of the garment hanger.

Conveniently, the second leg is shorter than the first leg to provide access to the aperture when the indicia tag is mounted on the web.

Alternatively, the second leg comprises a cutaway to provide access to the aperture when the indicia tag is mounted on the web.

Conveniently, a first portion of cooperating latching means is fixed relative to the first leg for cooperating with a second portion of the cooperating latching means fixed relative to the web.

Conveniently, the first portion of the cooperating latching means comprises a projection on an inner face of the first leg arranged for cooperating with a second portion of the cooperating latching means comprising an edge of the aperture.

Advantageously, the projection is a T-shaped projection having a stem portion in a direction of mounting the indicia tag on the web and a cross-bar portion substantially perpendicular thereto and away from a free end of the legs thereof.

Advantageously, the stem portion comprises a ramp having a cam face rising from an inner face of the first leg to the outer face of the cross-bar portion.

Alternatively, the first portion of the cooperating latching means comprises a first projection on an inner face of the first leg arranged to cooperate with a second portion of the cooperating latching means located on the web.

Conveniently, the first projection comprises first ramp means have a first cam surface arranged to cooperate with a second cam surface on second ramp means of the second projection.

Conveniently, a major face of the first leg is substantially quadrant shaped.

Conveniently, a major face of the second leg is substantially quadrant shaped.

Alternatively, a major face of the second leg is substantially rectangular.

Advantageously, the indicia tag comprises on an inner face thereof a seat for receiving an outer edge of the web.

Conveniently, information is printed or affixed to at least one outer face of the indicia tag.

According to a third aspect of the invention, there is provided a garment hanger comprising: a web arranged to latch a resilient indicia tag thereto, the web defining an aperture therethrough, such that the web is receivable between a first leg and a second leg, opposed to the first leg, of an indicia tag, the indicia tag being substantially U-shaped in cross-section; and a first element of latching means on the web for cooperating with a second element of the latching means on an inner face of the first leg for latching the indicia tag to the web arranged such that with the indicia tag latched to the web an inner face of the first leg is accessible through the aperture to a tool resiliently to flex at least a portion of the first leg away from the web such that the latching means mutually disengage.

Advantageously, the web comprises a peripheral step between the web and an adjacent outer face of the garment hanger, the step being of a height at least substantially equal to a thickness of the legs of the indicia tag such that with the indicia tag mounted on the web edges of the indicia tag abut the step with substantially no fingernail purchase therebetween and major outer faces of the indicia tag are substantially coplanar with adjacent outer faces of the garment hanger.

Conveniently, a second portion of the cooperating latching means fixed relative to the web is arranged to cooperate with a first portion of the cooperating latching means fixed relative to the first leg.

Conveniently, the second portion of the cooperating latching means comprises an edge of the aperture arranged to cooperate with the first portion of the cooperating latching means comprising a projection on an inner face of the first leg.

Alternatively, the second portion of the cooperating latching means comprises a second projection on the web arranged to cooperate with a first portion of the cooperating latching means comprising a first projection on an inner face of the first leg.

Conveniently, the second projection comprises second ramp means having a second cam surface arranged to cooperate with a first cam surface on the first projection.

Conveniently, the web is located at a junction of suspension hook means of the garment hanger and a median portion of the garment hanger.

Conveniently, the suspension hook means and median portion are moulded in one piece.

Alternatively, the suspension hook means is moulded separately from remaining portions of the garment hanger and the web is located on the suspension hook means.

Conveniently, a major face of the web arranged to receive the first leg is substantially quadrant shaped.

Conveniently, a major face of the web arranged to receive the second leg is substantially quadrant shaped.

Alternatively, a major face of the web arranged to receive the second leg is substantially rectangular.

Conveniently, the aperture is provided with an outermost ramped edge for guiding the tool.

The invention will now be described, by way of example, with reference to the accompanying drawings in which.

In the Figures like reference numerals denote like parts.

Figure 1:
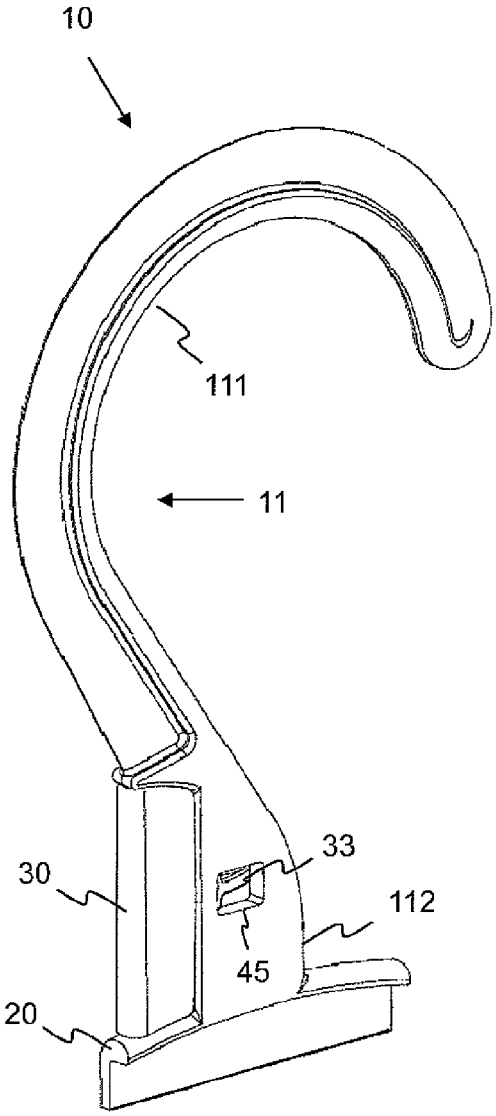
FIG. 1 is a perspective view from the rear and a first side of a first embodiment of a portion of a garment hanger with an indicia tag attached, according to the invention.
Figure 2:
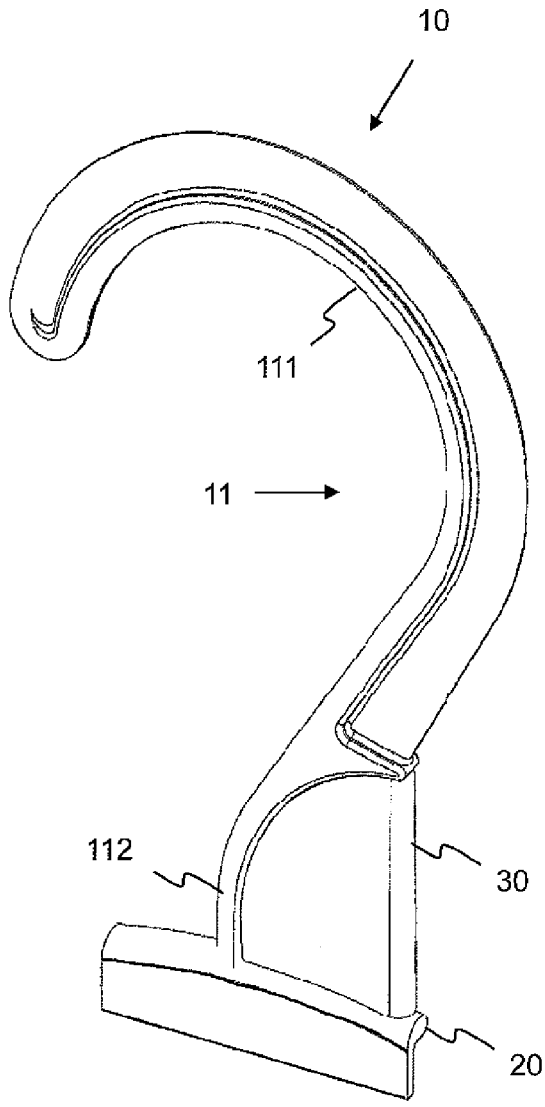
FIG. 2 is a perspective view from the front and the first side of the portion of a garment hanger with an indicia tag attached of FIG. 1.

Referring to FIGS. 1 and 2, a portion of a first garment hanger 10 according to the invention comprises a suspension hook 11 for suspending the garment hanger from, for example, a rail, not shown. The hook has an arcuate portion 111 joined by a shank portion 112 to a median portion 20 of the garment hanger. The median portion 20 may bridge two opposed arms, not shown, from which a garment may be suspended. However, it will be understood that other means of supporting a garment, such as a single arm or ring may be provided joined to the median portion. Located between the shank portion 112, a first portion of the arcuate portion 111 of the hook proximate the shank portion 112 and a portion of the median portion 20 proximate the shank portion 112 is a substantially quadrant-shaped indicia tag 30. It will be understood that hook 11 may be moulded in one piece with the median portion 20 or separately therefrom.

Figure 3:
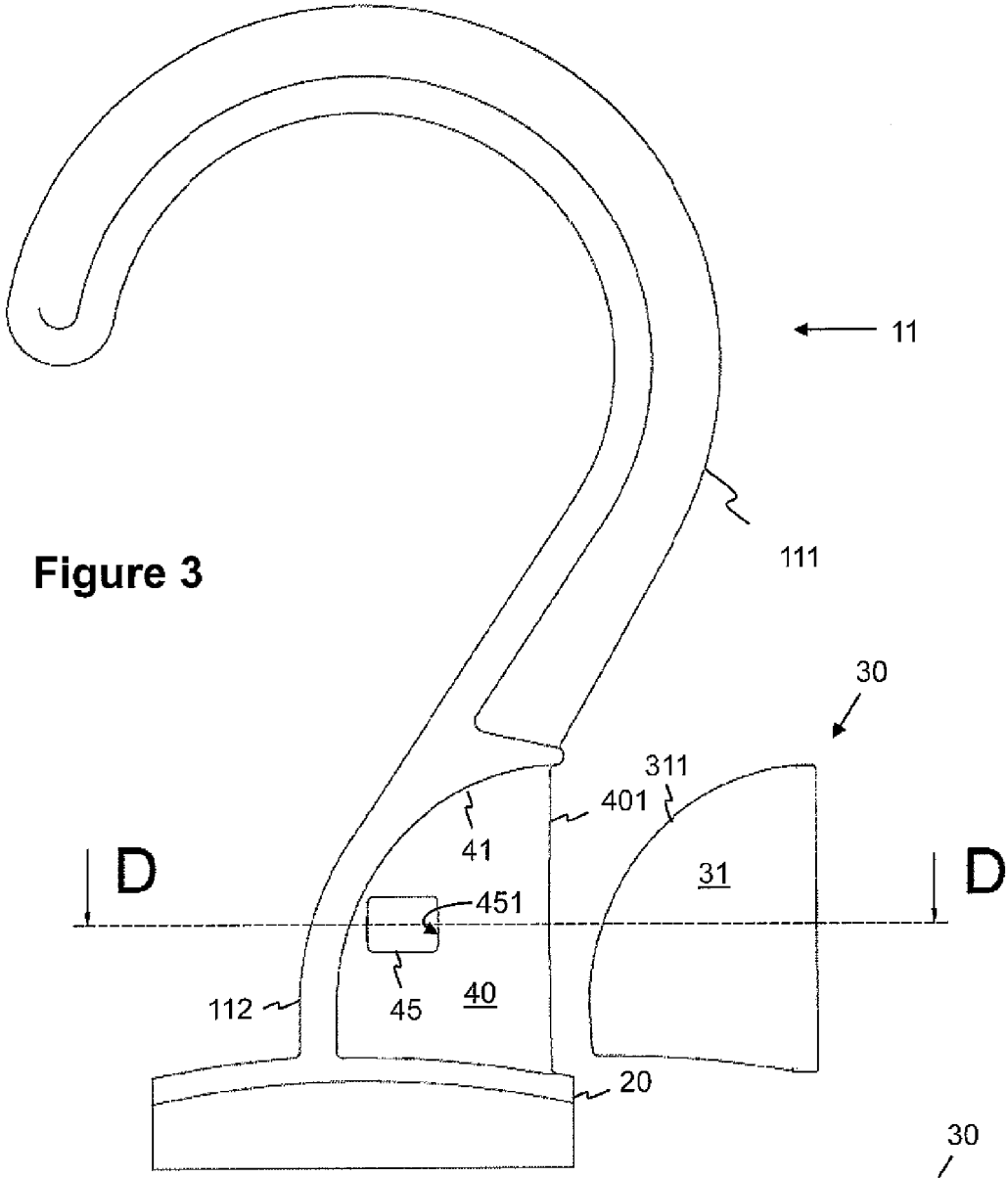
FIG. 3 is a front view of the portion of a garment hanger and an indicia tag of FIG. 1 with the indicia tag unattached.
Figure 4:
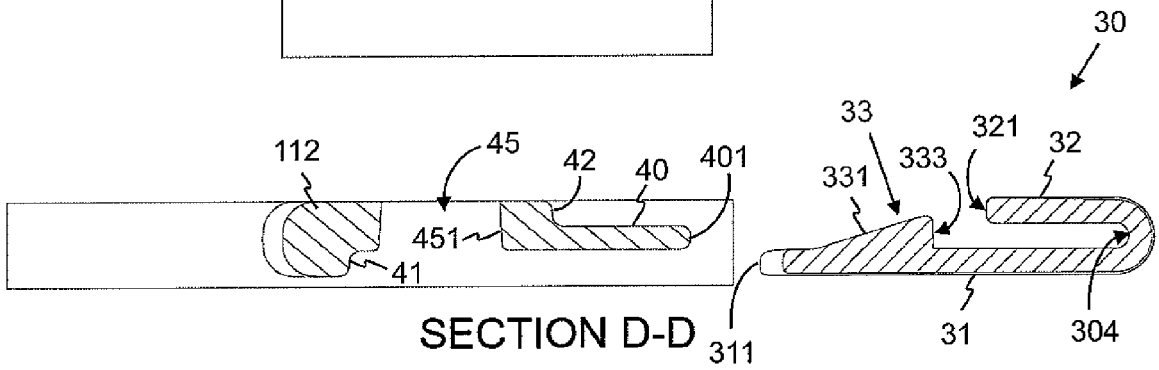
FIG. 4 is an enlarged transverse cross-sectional view along line D-D of FIG. 3.
Figure 7:
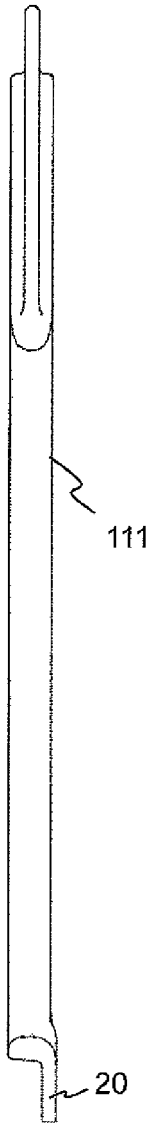
FIG. 7 is a view of a second side, opposed to the first side, of the portion of a garment hanger of FIG. 5.
Figure 8:
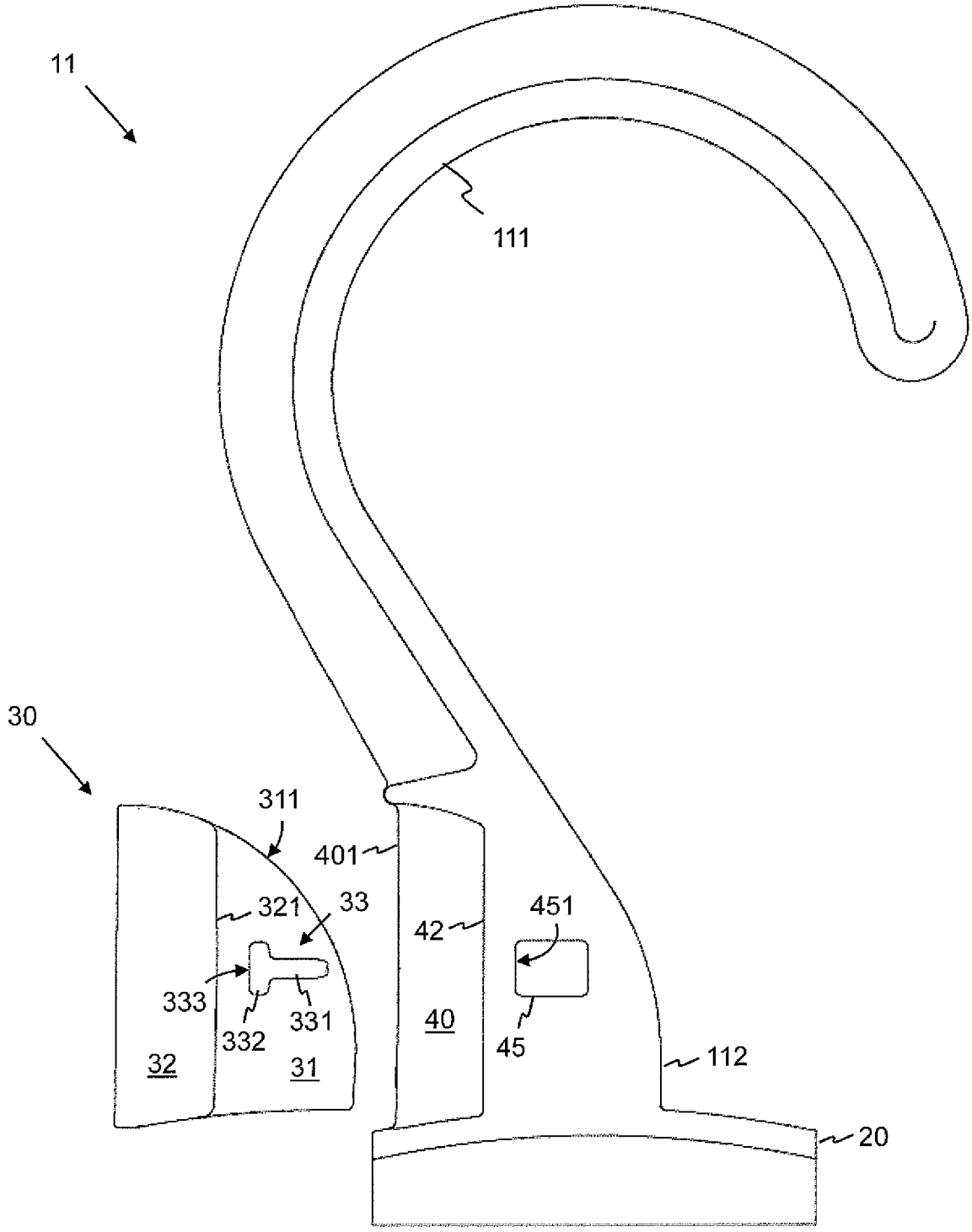
FIG. 8 is a rear view of the portion of a garment hanger and an indicia tag with the indicia tag unattached of FIG. 3.

As best seen in FIGS. 3 and 4, the quadrant-shaped indicia tag 30 has a substantially U-shaped transverse cross-section with a front leg 31 substantially longer than a rear leg 32 opposed to the front leg. As best seen in FIGS. 4 and 8 an inner face of a portion of the front leg 31 extending beyond the rear leg 32 is provided substantially centrally in a vertical direction in use of the indicia tag with a T-shaped projection 33 having a ramped, horizontal in use, stem 331 leading to a vertical in use cross-piece 332, such that the ramped stem 331 is towards a free end of the front leg 31 of the U-shaped indicia tag 30. It will be understood that a T-shaped projection has an advantage of minimising sink marks on the front face of the indicia tag, but from the following discussion it will be clear that other shapes of projection may alternatively be used.

As best seen in FIGS. 3, 4 and 8 a web 40 having a substantially quadrant-shaped front face and substantially rectangular rear face, dimensioned to receive the substantially-quadrant shaped indicia tag, is located between the shank portion 112, a first portion of the arcuate portion 111 of the hook 11 proximate the shank portion 112 and a portion of the median portion 20, proximate the shank portion 112.

It will be understood that in other embodiments of the invention the web may be located at other locations on the hanger, for example on a body of the garment hanger or on a different place on the hook. In further embodiments a web is over-moulded onto a standard metal wire hook. This gives strength and appearance characteristics of the metal but with the functionality of the web and size marker.

Figure 5:
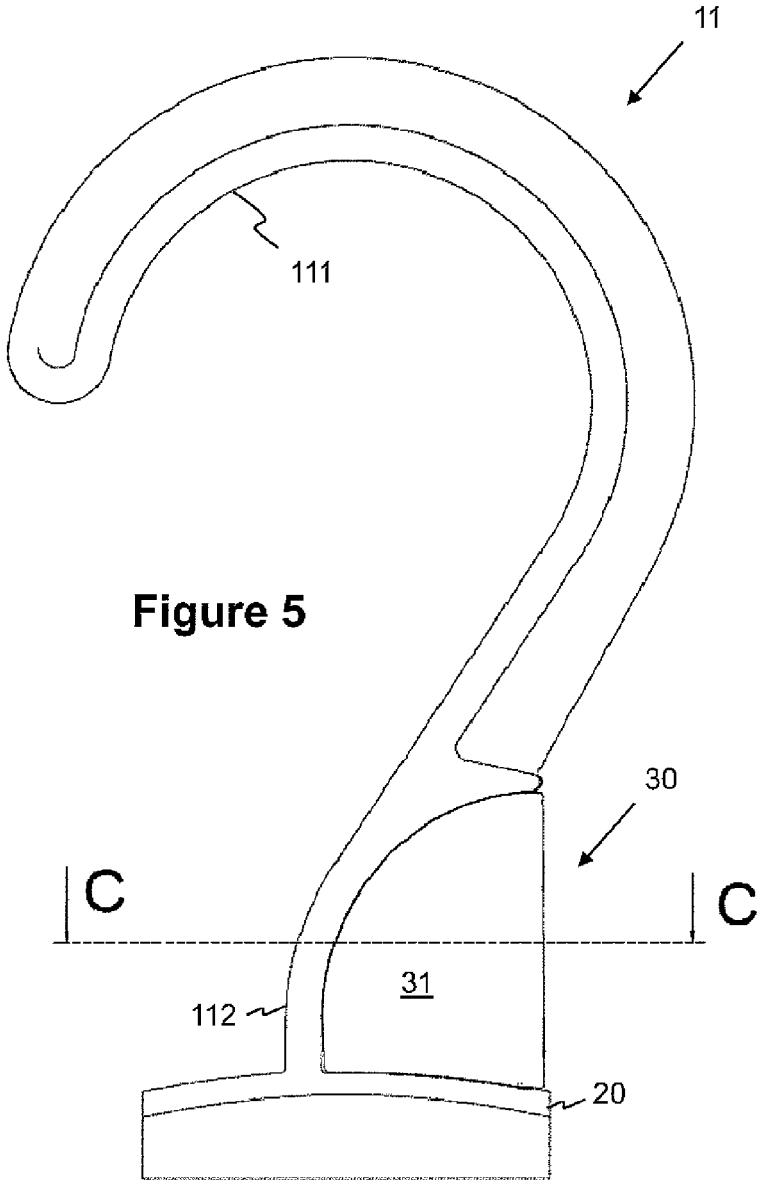
FIG. 5 is a front view of the portion of a garment hanger and an indicia tag of FIG. 1 with the indicia tag attached.
Figure 6:
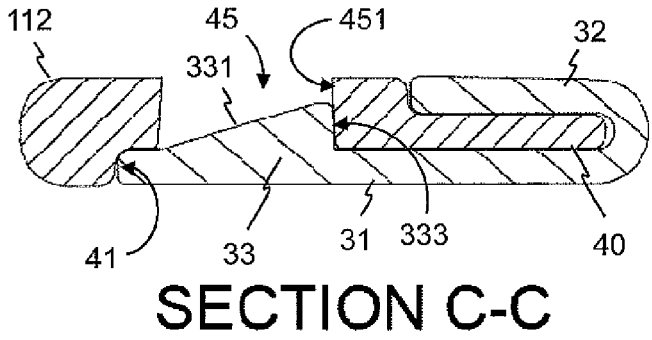
FIG. 6 is an enlarged transverse cross-sectional view along line C-C of FIG. 5.
Figure 9:
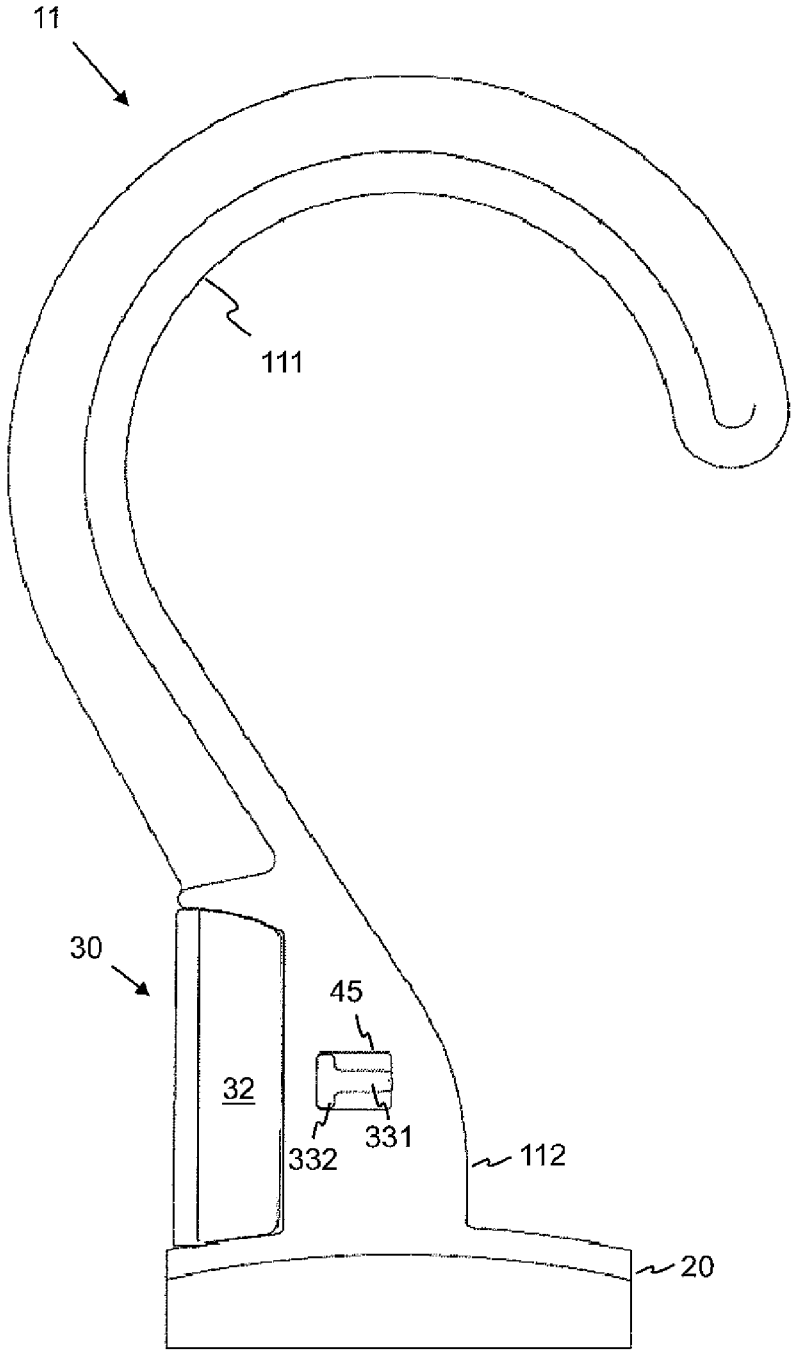
FIG. 9 is a rear view of the portion of a garment hanger and an indicia tag of FIG. 1 with the indicia tag attached.
Figure 10:
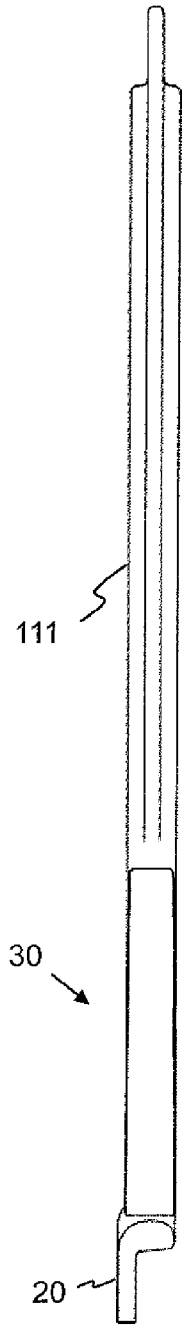
FIG. 10 is a view of the first side of the garment hanger and an indicia tag of FIG. 1 with the indicia tag attached.

As best seen in FIGS. 3 and 4, a front face of the web 40 is provided with a arcuate step 41 defining an inward edge of the front face of the web 40 and conforming to a leading edge 311 of the front leg 31 such that a front face of the web 40 is stepped inwards of the front face of the hook so that with the indicia tag located on the garment hanger, as shown in FIGS. 2, 5 and 6, the front face of the indicia tag 30 is substantially coplanar with the front face of the hook 11. Similarly, as best seen in FIGS. 4 and 8, a rear face of the web 40 is provided with a linear step 42 conforming to a linear leading edge 321 of the rear leg 32 such that a rear face of the web 40 is stepped inwards of the rear face of the hook such that with the indicia tag located on the garment hanger, as shown in FIGS. 1, 6 and 9 the rear face of the indicia tag 30 is substantially coplanar with the rear face of the hook 11.

As best seen in FIGS. 1, 3 and 8 the web 40 is provided inward of the straight step 42 and substantially vertically central of the web with a substantially rectangular aperture 45 dimensioned and located to accommodate and cooperate with the T-shaped projection 33 on the inner face of the front leg 31.

It will be understood that other shapes of aperture could alternatively be used.

Referring to FIGS. 3, 4 and 8, to mount the indicia tag 30 on the garment hanger the indicia tag is presented to the web 40 such that an outer edge 401 of the web, which is vertical in use, passes between the front leg 31 and the rear leg 32 of the indicia tag, the T-shaped projection 33 bearing on the front face of the web 40 tending to angle the front leg 31 away from the web 40. As the indicia tag 30 is pushed further onto the web 40 the indicia tag tends to rotate about a vertical axis so that an angle between the front leg 31 and front face of the web 40 decreases, as the cross-piece 332 of the T-shaped projection 33 slides along the front face of the web 40. The T-shaped projection 33 finally snaps into the aperture with an outward facing edge 333 of the T-shaped projection engaging a vertical inward facing edge 451 of the aperture 45 to latch the tag 30 on the garment hanger 10. In this position the arcuate leading edge 311 of the front leg abuts the step 41 on the front face of the web, the leading edge 321 of the rear leg abuts the linear step 42 on the rear face of the web and lower edges of the front and rear legs abut an upper face of the median portion 20 to which they conform, such that a fingernail purchase cannot be obtained on any free edge of the mounted indicia tag so that the tab cannot be removed without a tool, to prevent removal and ingesting by a child or accidentally dislodgement by a customer. Moreover an inner face 304 at an apex of the U-shaped indicia tag between the front leg and the rear leg abuts, or is proximate to, the outer edge 401 of the web 40, such that there is almost no freedom of movement for the indicia tag to rock on the garment hanger.

In order to remove the indicia tag it is therefore necessary to insert a tool, not shown, such as, for example, a rod or probe with a rounded free end, from a rear of the hook through the aperture 45 to bear on the ramped stem 331 of the T-shaped projection 33. It will be understood that tools of other shapes which can at least partially enter the aperture could alternatively be used. This forces the front leg 31 of the indicia tag 30 away from the front face of the web 40 to unlatch the edge 333 of the projection 33 from the edge 451 of the aperture 45. The tool passing down the cam surface of the ramped stem portion of the T-shaped projection together with the resilience of the indicia tag tends to cause the tag to spring off the web and away from the hanger.

This has an advantage in the application of an automated tool for the rapid removal of the tag that it is unnecessary to grasp the tag to remove the tag from the hanger. Automated removal of the tag facilitates efficient re-use or recycling of either or both of the indicia tag and garment hanger. However, it will be understood that the indicia tag can also be removed with a hand tool, for example in a retail establishment, for example in order to replace a indicia tag on a garment hanger.

In the prior art which incorporates a live hinge for a latch, the latch needs to be made from a material such as polypropylene which allows repeated flexing. The latch possibly could be moulded as part of a separate hook which attaches to a body of a different material. Alternatively the latch could be moulded as part of the body and a hook of a different material attached to the body. In either case, the fact that the latch has to be of a particular material limits and constrains the design. If a whole garment hanger is moulded in a resilient material such as polypropylene to provide the resilience needed for the live hinge, the hanger may be provided with thicker wall sections than would be necessary in a material such as polystyrene, for instance. The thicker walls are to combat the possibility of creep either in the hook or body areas of a polypropylene garment hanger.

By not having moving parts on the web the garment hanger of the invention has more design freedom in a choice of materials for the garment hanger. Although polypropylene could be used, alternatively a less resilient material such as polycarbonate could be used, which is not possible in the prior art garment hanger with a latch attached to the garment hanger by a live hinge.

It will be understood that information can be printed or affixed to any one or more of the three outer faces of the indicia tag which are visible in use.

Figure 11:
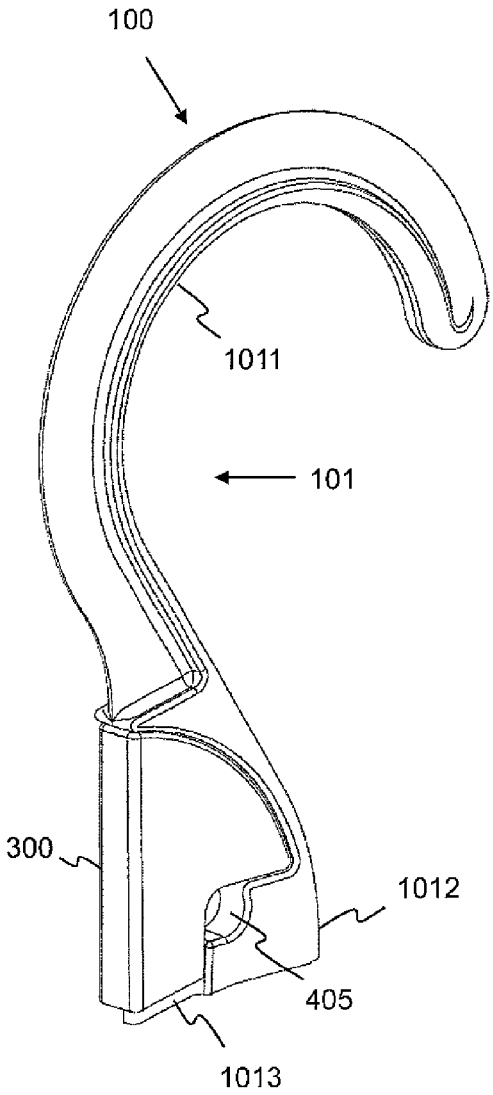
FIG. 11 is a perspective view from the rear and a first side of a second embodiment of a portion of a garment hanger with an indicia tag attached, according to the invention.
Figure 12:
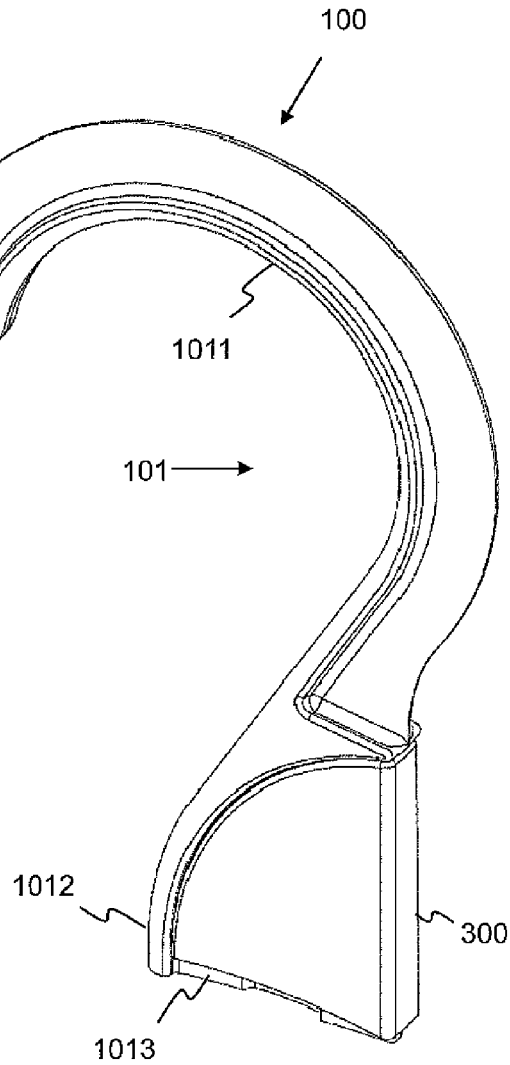
FIG. 12 is a perspective view from the front and the first side of the portion of a garment hanger with an indicia tag attached of FIG. 11.

Referring to FIGS. 11 and 12, a portion of a second garment hanger 100 according to the invention comprises a suspension hook 101 for suspending the garment hanger from, for example, a rail, not shown. The hook has an arcuate portion 1011 joined to a shank portion 1012. The shank portion may be joined to a median portion, not shown, of a garment hanger. The median portion may bridge two opposed arms, not shown, from which a garment may be suspended. However, it will be understood that other means of supporting a garment, such as a single arm or ring may be provided joined to the median portion or directly to the garment hanger. Located between the shank portion 1012, a first portion of the arcuate portion 1011 of the hook proximate the shank portion 1012 and a base portion 1013 of the hook proximate the shank portion 1012 is a substantially quadrant-shaped indicia tag 300. It will be understood that hook 101 may be moulded in one piece with the median portion of a garment hanger or separately therefrom.

Figure 13:
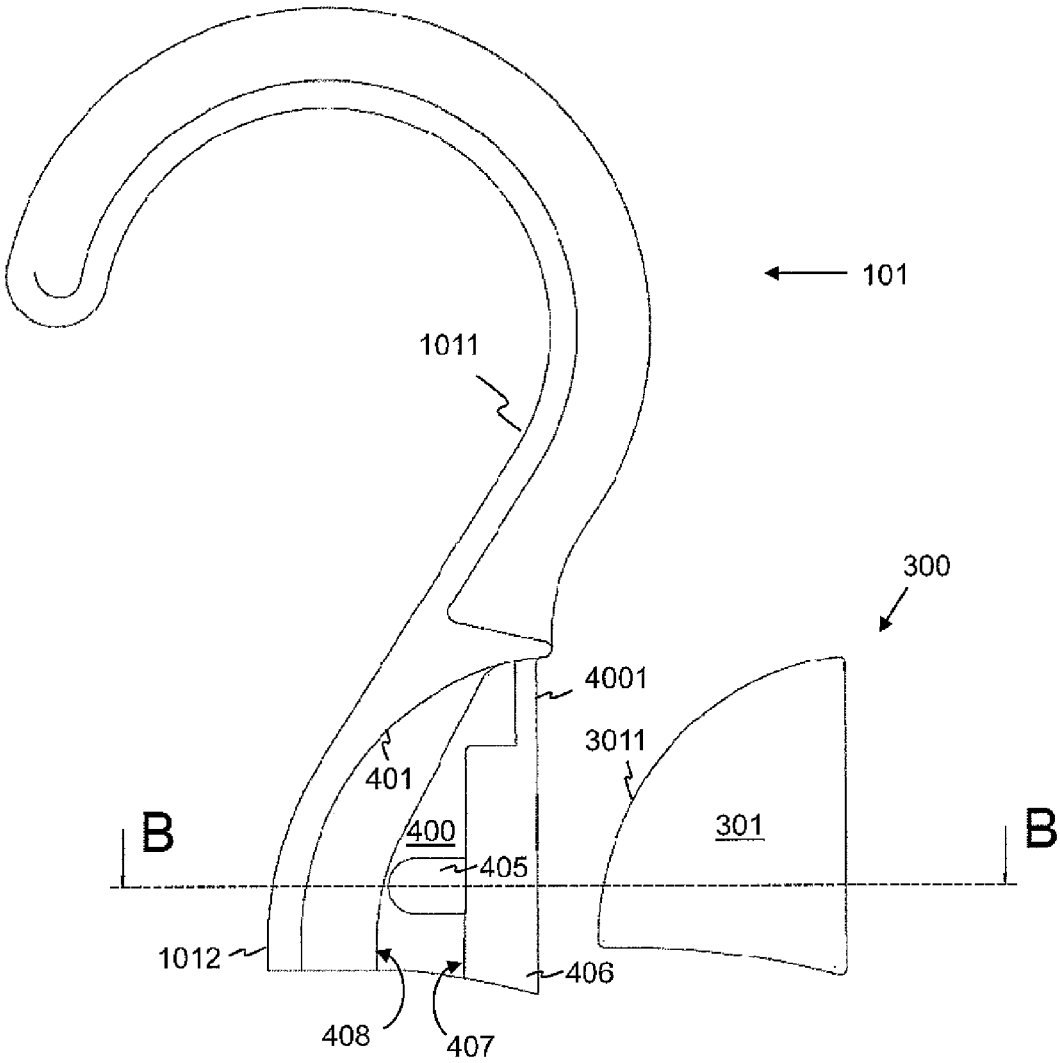
FIG. 13 is a front view of the portion of a garment hanger and an indicia tag of FIG. 11 with the indicia tag unattached.
Figure 14:
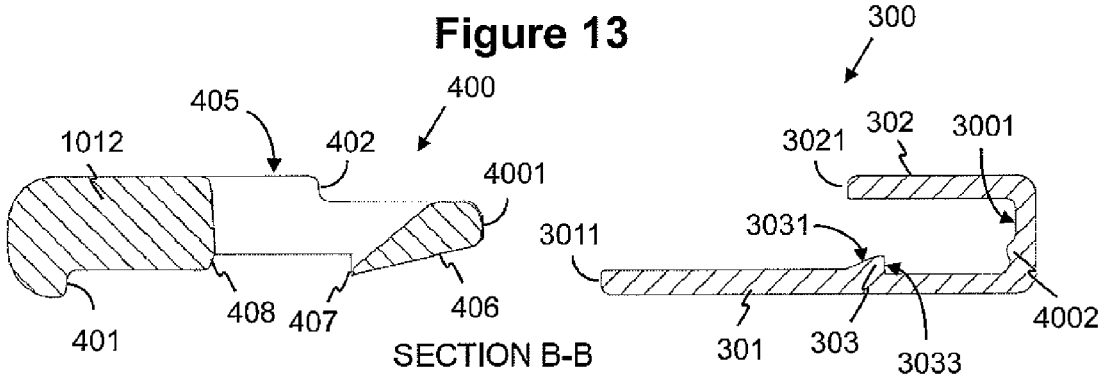
FIG. 14 is an enlarged transverse cross-sectional view along line B-B of FIG. 13.
Figure 17:
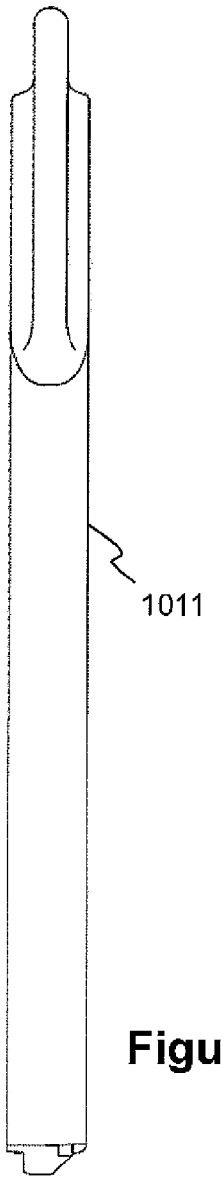
FIG. 17 is a view of a second side, opposed to the first side, of the portion of a garment hanger of FIG. 15.
Figure 18:
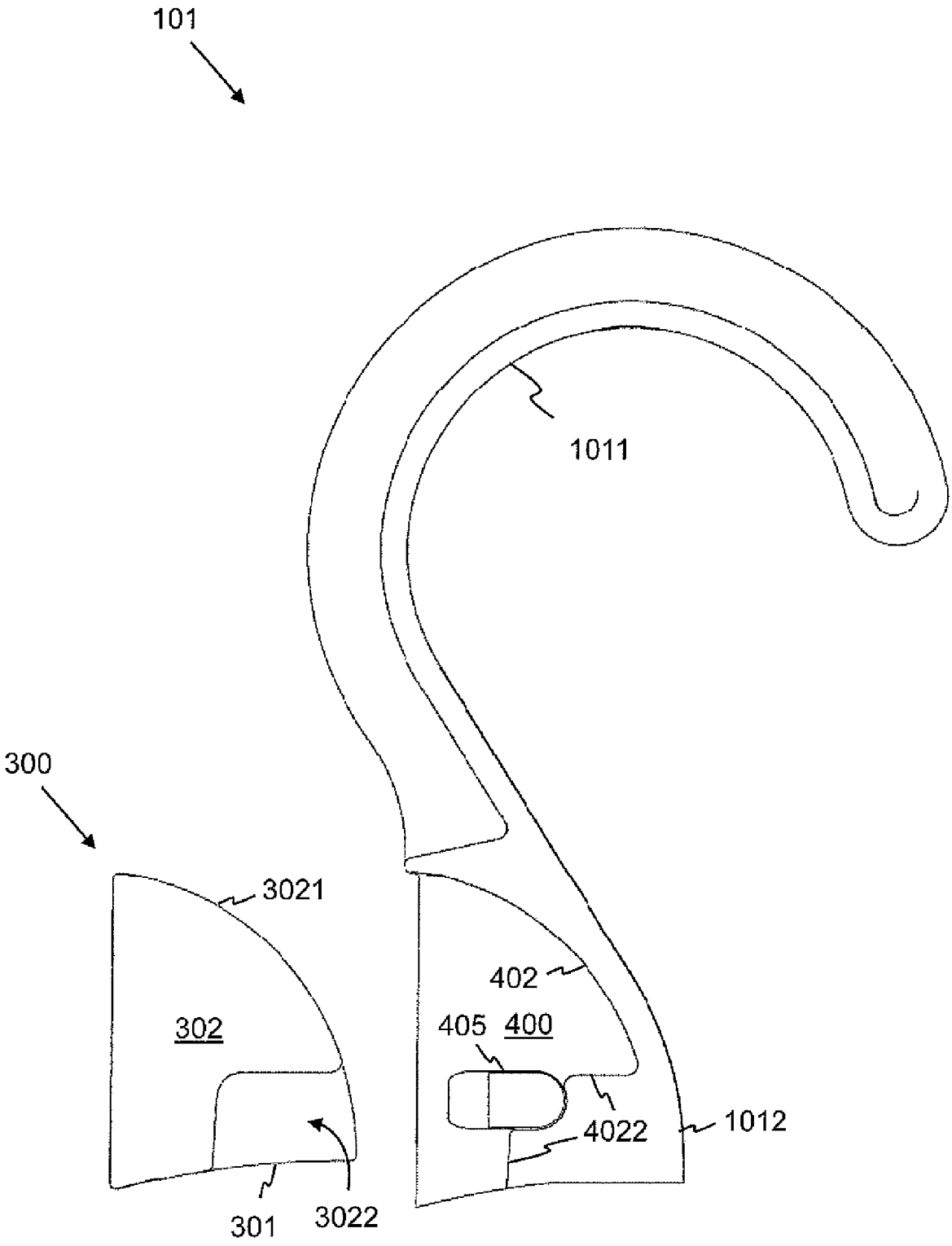
FIG. 18 is a rear view of the portion of a garment hanger and an indicia tag with the indicia tag unattached of FIG. 13.

As best seen in FIGS. 13, 14, 18 and 19 the quadrant-shaped indicia tag 300 has a substantially U-shaped transverse cross-section with a front leg 301 substantially a same length as a rear leg 302 opposed to the front leg, but as shown in FIG. 18 with a lower cutaway portion 3022 of the rear leg so that proximate a base of the indicia tag the rear leg 302 is shorter than the front leg 301 as shown in FIGS. 14 and 18. As best seen in FIG. 14 an inner face of a portion of the front leg 301 between the front leg and the rear leg 302 is provided with a ramp projection 303 extending in a vertical direction in use and having a cam surface 3031 towards a free end of the front leg 301 of the U-shaped indicia tag 300.

As best seen in FIGS. 13, 14 and 18 a web 400 having a substantially quadrant-shaped front face and a substantially quadrant-shaped rear face, dimensioned to receive the substantially-quadrant shaped indicia tag 300, is located between the shank portion 1012, a first portion of the arcuate portion 1011 of the hook 101 proximate the shank portion 1012 and a base 1013 of the hook, proximate the shank 1012.

Figure 15:
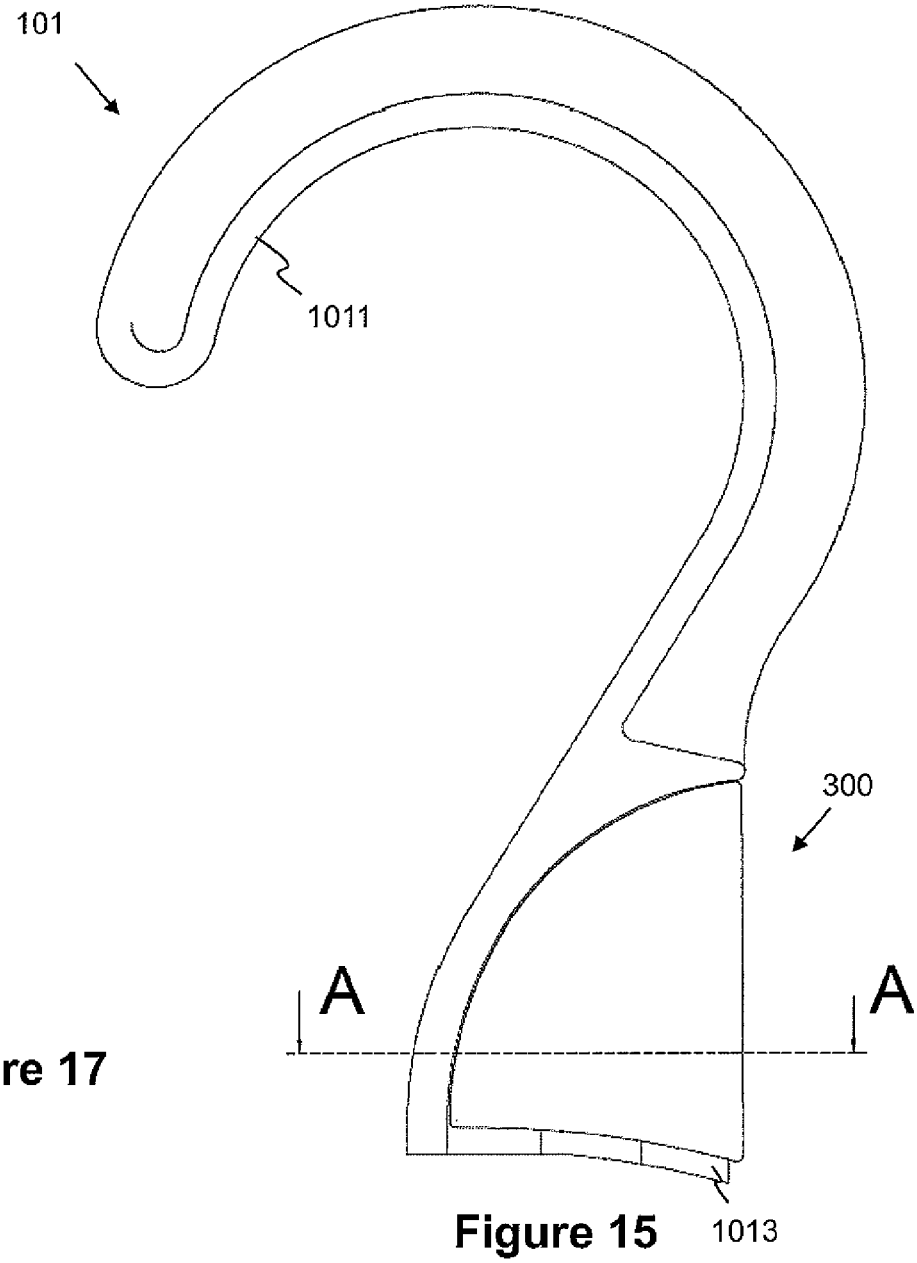
FIG. 15 is a front view of the portion of a garment hanger and an indicia tag of FIG. 11 with the indicia tag attached.
Figure 16:
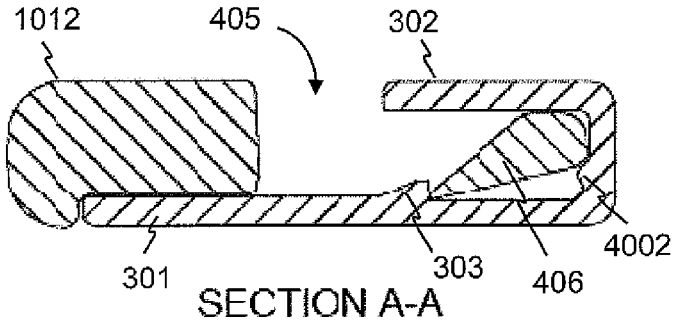
FIG. 16 is an enlarged transverse cross-sectional view along line A-A of FIG. 15.

As best seen in FIGS. 13 and 14, a front face of the web 400 is provided with a arcuate step 401 defining an inner edge of the front face of the web 400 and conforming to a leading edge 3011 of the front leg 31 such that a front face of the web 400 is stepped inwards of the front face of the hook so that with the indicia tag located on the garment hanger, as shown in FIGS. 12, 15 and 16, the front face of the indicia tag 30 is substantially coplanar with the front face of the hook. In addition, the front face of the web is provided with a ramp 406 with a cam surface rising from an outer edge 4001 of the web, which is substantially vertical in use, to an engagement face 407 perpendicular to the web 400. Additionally, there is a second step 408 on the front face of the web, between the first step 401 defining an inner edge of the front face of the web 400 and the engagement face 407 to form a well between the second step 408 and the engagement face 407 of the ramp 406.

Figure 21:
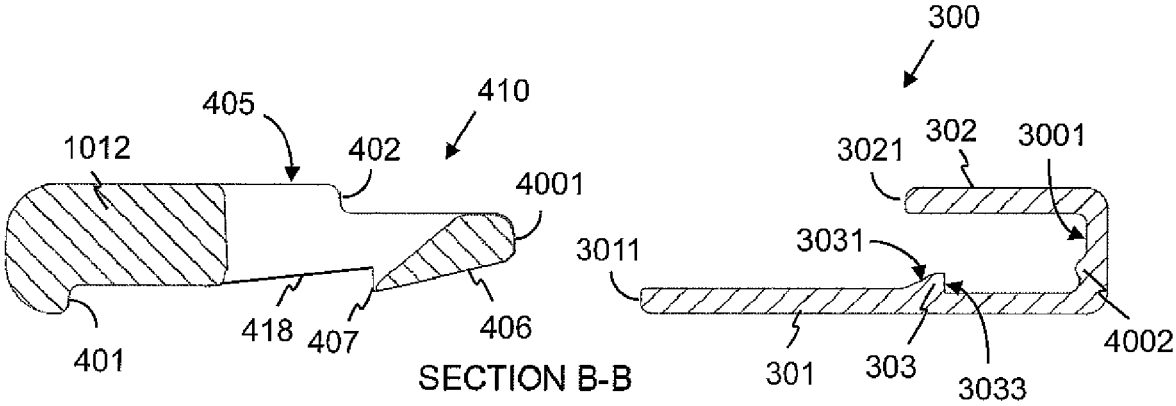
FIG. 21 is a transverse cross-sectional view, similar to the view of FIG. 14, of a portion of a garment hanger and an indicia tag according to a third embodiment of the invention, with the indicia tag unattached.

In an alternative embodiment, illustrated in FIG. 21, only a single step 401 is provided on the front face of the web 410, against which a leading edge 3011 of the front leg 301 abuts, to prevent a finger purchase being obtained on the leading edge 3011, and a well 418 with a ramped floor is provided to accommodate the projection 3031 on an inner face of the front leg.

Figures 19, 20:
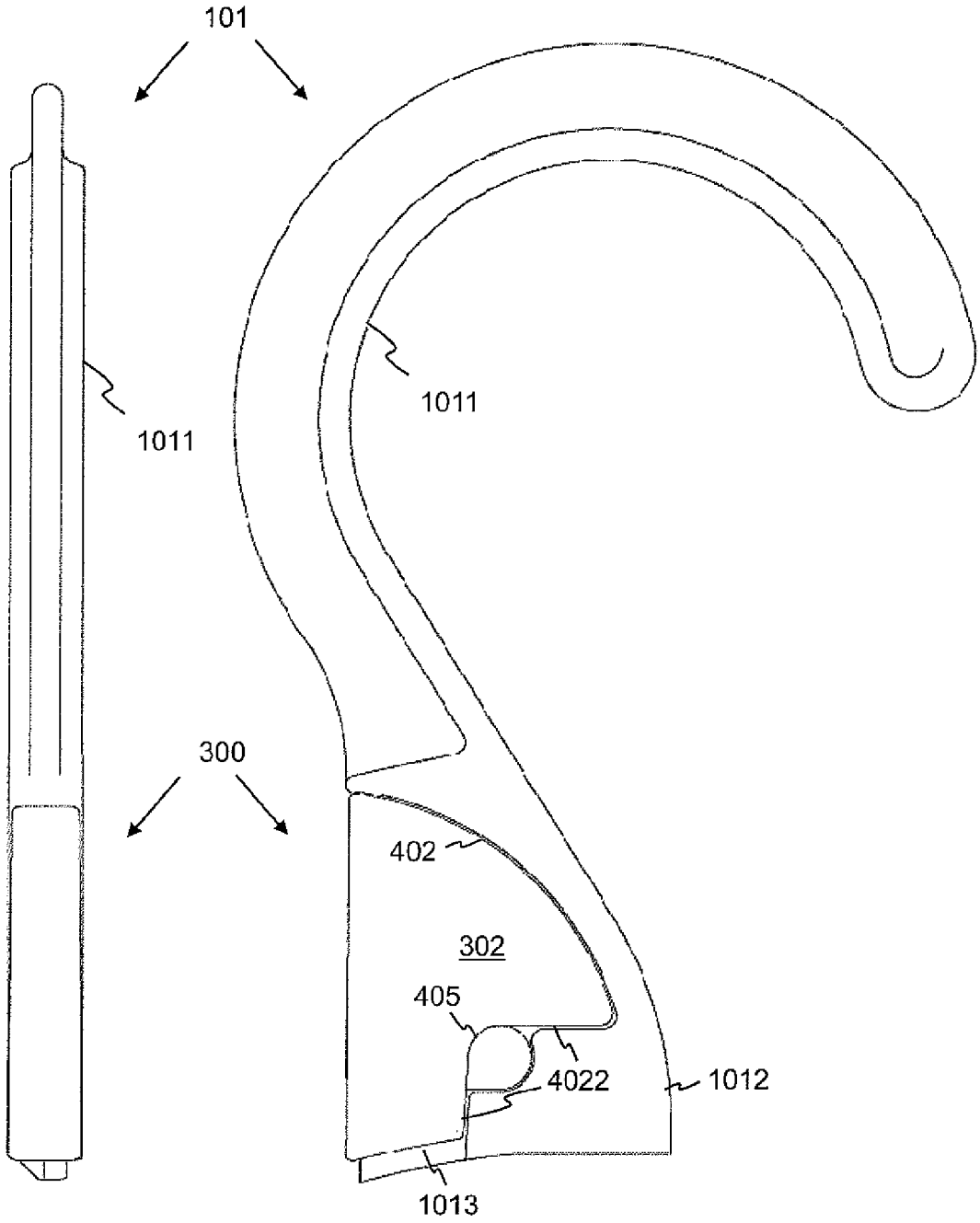
FIG. 19 is a rear view of the portion of a garment hanger and an indicia tag of FIG. 11 with the indicia tag attached.
FIG. 20 is a view of the first side of the garment hanger and an indicia tag of FIG. 11 with the indicia tag attached.

Similarly, as best seen in FIGS. 14 and 18, a rear face of the web 40 is provided with an arcuate step 402, conforming to an arcuate leading edge 3021 of the rear leg 302, including a substantially right-angled portion 4022 conforming to edges of the rectangular cutaway portion 3022, such that a rear face of the web 400 is stepped inwards of the rear face of the hook so that with the indicia tag 300 located on the garment hanger, as shown in FIGS. 11, 16 and 19, the rear face of the indicia tag 300 is substantially coplanar with the rear face of the hook 101.

As best seen in FIGS. 11, 13 and 18 the web 40 is provided inward of the ramp 406 with a substantially rectangular aperture 405 with a rounded inward end. It will be understood that other shapes of aperture could alternatively be used. An outward end of the aperture is provided with a cam surface inclined inward of the web as viewed from a rear of the hook. This cam surface may be helpful in some embodiments to guide a tool out of the aperture but has been found in practice not to be necessary.

To mount the indicia tag 300 on the garment hanger the indicia tag is presented to the web 400 such that an outer edge 4001 of the web, which is vertical in use, passes between the front leg 301 and the rear leg 302 of the indicia tag 300 until the cam surface 3031 of the indicia tag engages the cam surface of the ramp 406 of the web. On pushing the tag further onto the web the cam surface 3031 rides up the cam of the ramp 406 forcing the front and rear legs apart until the projection 303 passes over the ramp 406 when the front leg snaps onto the front face of the web 400 with the perpendicular outward face 3033 of the projection 303 engaging the perpendicular inward face 407 of the ramp 406 to latch the indicia tag onto the web.

In this position the arcuate leading edge 3011 of the front leg 301 abuts the step 401 on the front face of the web, the leading edge 3021 of the rear leg abuts the arcuate step 402 on the rear face of the web and lower edges of the front and rear legs abut an upper face of the base portion to which they conform, such that a fingernail purchase cannot be obtained on any free edge of the mounted indicia tag. Moreover an inner face 3001 at an apex of the U-shaped indicia tag between the front leg 301 and the rear leg 302 abuts, or is proximate to, the outer edge 4001 of the web 40, such that there is almost no freedom of movement for the indicia tag to rock on the garment hanger. Such freedom of movement is further inhibited by a projection 4002 on the inner face 3001 which forms a seat therebetween and the inner face 3001 and an inner face of the rear leg 302 for receiving the edge 4001.

In order to remove the indicia tag it is therefore necessary to insert a tool, such as, for example, a rod or probe with a rounded free end, from a rear of the hook through the aperture to bear on an inner face of the front leg 301. It will be understood that tools of other shapes which can at least partially enter the aperture could alternatively be used. This forces the front leg of the indicia tag away from the front face of the web to unlatch the edge 3033 of the projection 303 from the edge 407 of the ramp 406. The tool pressing on the inner surface of the front leg of the indicia tag together with the resilience of the indicia tag tends to cause the tag to spring off the web and away from the hanger.

This has an advantage in the application of an automated tool for the rapid removal of the tag that it is unnecessary to grasp the tag to remove the tag from the hanger. Automated removal of the tag facilitates efficient re-use or recycling of either or both of the indicia tag and garment hanger.

A further advantage of the invention is that only the tag needs to be sufficiently resilient to survive repeated flexing.

The invention also has the advantage that embodiments of the tag-receiving web can be formed either on a garment hanger in which the suspension hook is integrally moulded with the rest of the garment hanger or on a garment hanger hook moulded separately from the rest of the garment hanger.

It will be understood that information can be printed or affixed to any one or more of the three outer faces of the indicia tag which are visible in use.

Although indicia tag tabs have been described in which at least the front face is substantially quadrant shaped, it will be understood that other shaped indicia tag tabs could be used, for example, with a rectangular or substantially rectangular shape.

Although the embodiments have been described in which the front leg is latched to the web of the garment hanger, it will be understood that this is merely a matter of nomenclature and equally the rear leg could latch to the web. Moreover, it will be understood that in some embodiments both the front and rear leg latch to the web and two tools, one from the front and one from the rear of the web are used to unlatch the indicia tag from the web, wherein the aperture in the web is sufficiently large to accommodate both tools or two separate apertures are provided.

The invention claimed is:

1. A combination of a garment hanger and a resilient indicia tag:

wherein the garment hanger comprises a web;

wherein said web has a web first major face and a web second major face, said web has web aperture surfaces defining a web aperture extending from said web first major face to said web second major face, and said web aperture surfaces comprise a first web latching surface;

wherein the indicia tag is substantially U-shaped in cross-section, such that said cross-section has an indicia tab bottom at the bottom of the U shape, a first leg extending from said indicia tag bottom, and a second leg extending from said indicia tag bottom, said first leg having a first leg inner surface, said second leg having a second leg inner surface, at least a portion of said first leg inner surface adjacent said indicia tag bottom opposing at least a portion of said second leg inner surface adjacent said indicia tag bottom, and said indicia tag comprising an indicia tag latch structure protruding from said first leg inner surface towards said second leg inner surface, wherein said indicia tag latch structure defines an indicia tag latching surface facing said indicia tag bottom;

wherein said web and said indicia tag are structured so that said web and said indicia tag latch together in a latching relationship in which said indicia tag latching surface opposes said first web latching surface and in which a portion of said web is disposed in said U-shaped cross-section of said indicia tag;

wherein, when said web and said indicia tag are in said latching relationship, said first leg covers said web aperture and said second leg does not cover said web aperture, such that said first leg inner surface is accessible through said web aperture; and wherein said first leg is sufficiently resilient to survive repeated deformation of said first leg away from said web to an extent that said indicia tag latching surface no longer opposes said first web latching surface.

2. The combination of claim 1, wherein the web comprises a peripheral step between the web and an adjacent outer face of the garment hanger, the step being of a height at least substantially equal to a thickness of the legs of the indicia tag so that, with the indicia tag mounted on the web, an edge of the indicia tag abuts the step to prevent fingernail purchase there between and major outer faces of the indicia tag are substantially coplanar with adjacent outer faces of the garment hanger.

3. The combination of claim 1, wherein said indicia tag latch structure comprises a projection on said first leg inner surface.

4. The combination of claim 3, wherein the projection is a T-shaped projection having a stem portion in a direction of mounting the indicia tag on the web and a cross-bar portion substantially perpendicular thereto and distal from a free end of the legs thereof.

5. The combination of claim 4, wherein the stem portion comprises a ramp having a cam face rising from an inner face of the first leg to the outer face of the cross-bar portion.

6. The combination of claim 1, wherein said indicia tag latching surface forms a surface of a first projection on said first leg inner surface and said first web latching surface defines a second projection cooperating with said first projection.

7. The combination of claim 6, wherein the first projection comprises first ramp have a first cam surface and the second projection comprises second ramp having a second cam surface for cooperating with the first cam surface.

8. The combination of claim 1, wherein the web is located at a junction of suspension hook of the garment hanger and a median portion of the garment hanger.

9. The combination of claim 8, wherein the suspension hook and median portion are molded in one piece.

10. The combination of claim 8, wherein the suspension hook is molded separately from remaining portions of the garment hanger and the web is located on the suspension hook.

11. The combination of claim 1, wherein a major face of said first leg is substantially quadrant shaped.

12. The combination of claim 1, wherein a major face of said second leg is substantially quadrant shaped.

13. The combination of claim 1, wherein a major face of said second leg is substantially rectangular.

14. The combination of claim 1, wherein the indicia tag comprises on an inner surface thereof a seat for receiving an outer edge of the web.

15. The combination of claim 1, wherein said web aperture is provided with an outermost ramped edge.

16. The combination of claim 1, wherein information is printed or affixed to at least one outer face of the indicia tag.

* * * * *